US008104759B2

(12) United States Patent
Kawaguchi

(10) Patent No.: US 8,104,759 B2
(45) Date of Patent: Jan. 31, 2012

(54) SHEET FINISHING APPARATUS, SHEET FINISHING METHOD AND IMAGE FORMING APPARATUS

(75) Inventor: Takahiro Kawaguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 182 days.

(21) Appl. No.: 12/694,873

(22) Filed: Jan. 27, 2010

(65) Prior Publication Data

US 2010/0194022 A1 Aug. 5, 2010

Related U.S. Application Data

(60) Provisional application No. 61/150,255, filed on Feb. 5, 2009.

(51) Int. Cl.
*B65H 37/04* (2006.01)

(52) U.S. Cl. ..... 270/58.12; 270/58.08; 270/58.11; 270/58.17; 270/58.27; 271/235; 271/250; 271/314

(58) Field of Classification Search ..... 270/58.08, 270/58.11, 58.12, 58.17, 58.27; 271/233, 271/235, 250, 264, 275, 314
See application file for complete search history.

(56) References Cited

U.S. PATENT DOCUMENTS

| | | | | |
|---|---|---|---|---|
| 5,335,904 | A * | 8/1994 | Ryuzaki | 271/272 |
| 6,019,365 | A * | 2/2000 | Matsumura | 271/227 |
| 6,273,418 | B1 * | 8/2001 | Fujikura et al. | 271/228 |
| 6,736,394 | B2 * | 5/2004 | Herrmann et al. | 271/249 |
| 7,300,046 | B2 * | 11/2007 | Sugiyama et al. | 270/58.17 |
| 7,401,776 | B2 * | 7/2008 | Obuchi et al. | 271/228 |

FOREIGN PATENT DOCUMENTS

JP 2007-137668 A 6/2007

* cited by examiner

*Primary Examiner* — Leslie A Nicholson, III
(74) *Attorney, Agent, or Firm* — Patterson & Sheridan, LLP

(57) ABSTRACT

A sheet finishing apparatus includes: a conveying roller configured to convey a sheet to a storage tray; a positioning stopper provided in parallel to a conveying path for the sheet; an aligning roller configured to convey the sheet, move the sheet in a lateral direction orthogonal to a direction of the conveyance, and press the sheet against the stopper to laterally align the sheet; and a moving mechanism configured to move the position of the aligning roller in the conveying direction. The sheet finishing apparatus controls the position of the aligning roller according to a size of the sheet.

20 Claims, 6 Drawing Sheets

SHEET FINISHING APPARATUS, SHEET FINISHING METHOD AND IMAGE FORMING APPARATUS

CROSS-REFERENCE TO RELATED APPLICATION

This application is based upon and claims the priority of U.S. Provisional application No. 61/150,255, filed on Feb. 5, 2009, the entire contents of which are incorporated herein by reference.

TECHNICAL FIELD

The present invention relates to a sheet finishing apparatus and a sheet finishing method for applying finishing to sheets discharged from an image forming apparatus such as a copying machine, a printer, or a multi-function peripheral (MFP) and the image forming apparatus, and, more particularly to improvement of a staple unit configured to laterally aligning or stapling the sheets.

BACKGROUND

In recent years, in an image forming apparatus (e.g., MFP), a sheet finishing apparatus is provided adjacent to a post-stage of the MFP to apply finishing to sheets subjected to image formation. The sheet finishing apparatus is called finisher. The sheet finishing apparatus staples or punches sheets sent from the MFP and discharges the sheets from a discharge port to a storage tray.

As an example of a staple unit in the sheet finishing apparatus in the past, there is a sheet processing apparatus disclosed in JP-A-2007-137668.

In the example of JP-A-2007-137668, when a sheet printed by an image forming apparatus is conveyed to a finisher, the finisher conveys, with a conveying roller and a lateral alignment roller (an offset roller), the sheet in the direction of a storage tray. After the sheet passes the conveying roller, the finisher presses the sheet with the lateral alignment roller, moves the sheet in a direction orthogonal to the conveying direction, and presses a side end of the sheet against a positioning wall to laterally align the sheet. The finisher staples a corner portion of laterally-aligned sheets with a stapler.

However, when the lateral alignment of the sheet is performed by using the lateral alignment roller, the lateral alignment roller can move in the direction orthogonal to the conveying direction of the sheet but cannot move in the conveying direction of the sheet. Therefore, even if sizes of sheets are different, the sheets are always pressed in the same position to be laterally aligned. If a size of a sheet is large or small, there is a deficiency in that a lateral alignment failure occurs. When the lateral alignment cannot be satisfactorily performed, sheets cannot be accurately stapled.

SUMMARY

An object of the present invention is to provide a sheet finishing apparatus that can reduce a lateral alignment failure and accurately staple sheets even if a sheet size changes.

According to an aspect of the present invention, there is provided a sheet finishing apparatus comprising:

a storage tray on which a sheet is stacked;

a conveying roller configured to convey the sheet to the storage tray;

a positioning stopper provided in parallel to a conveying path for the sheet;

an aligning roller configured to convey the sheet, come into contact with the sheet, move the sheet in a lateral direction orthogonal to a direction of the conveyance, and press the sheet against the stopper to laterally align the sheet;

a moving mechanism configured to move the position of the aligning roller in the conveying direction; and a control section configured to control the position of the aligning roller according to a size of the sheet.

DETAILED DESCRIPTION

Figure 1:
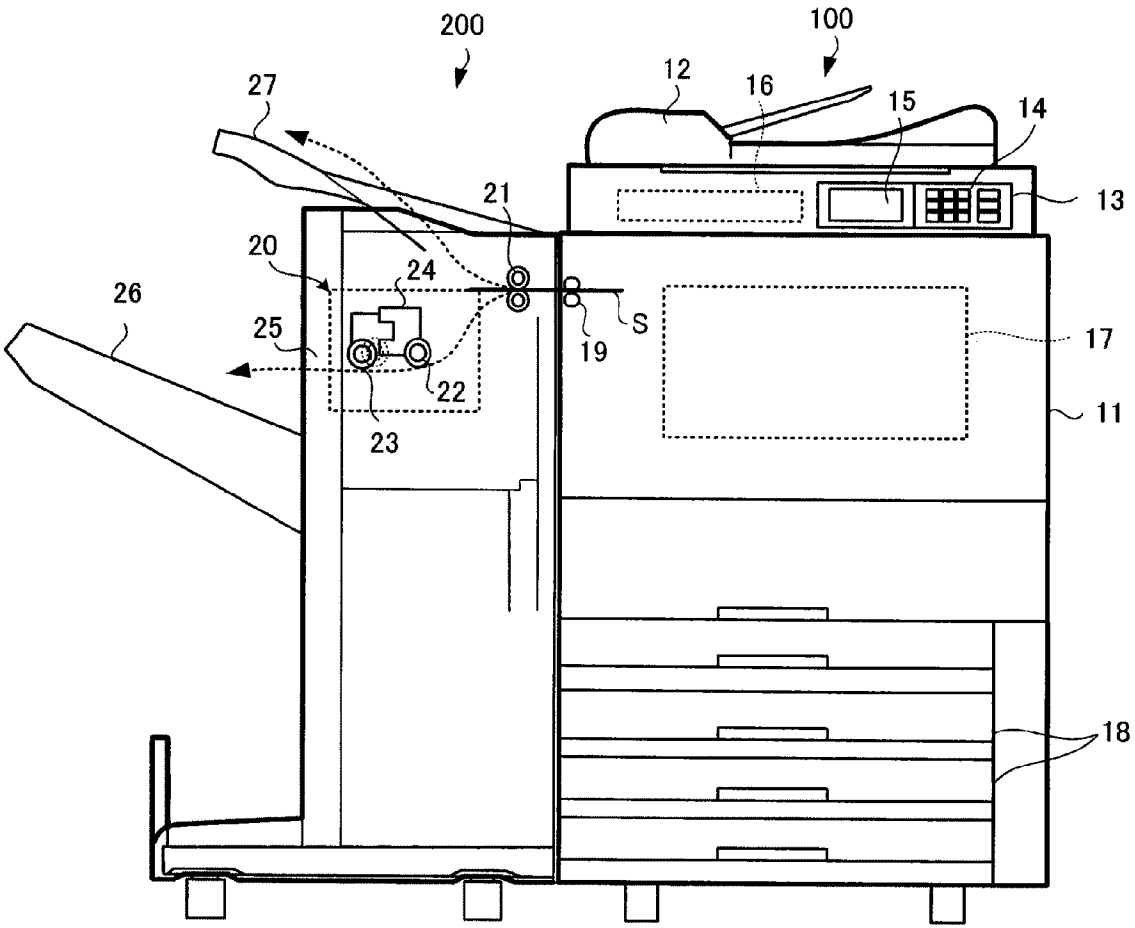
FIG. 1 is an overall diagram of a sheet finishing apparatus and an image forming apparatus according to an embodiment.

Throughout this description, the embodiments and examples shown should be considered as exemplars, rather than limitations on the apparatus of the present invention.

A sheet finishing apparatus according to an embodiment is explained in detail below with reference to the accompanying drawings. In the respective figures, the same components are denoted by the same reference numerals and signs.

FIG. 1 is a diagram of an image forming apparatus including the sheet finishing apparatus. In FIG. 1, reference numeral 100 denotes the image forming apparatus such as a multi-function peripheral (MFP) as a complex machine, a printer, or a copying machine. A sheet finishing apparatus 200 is arranged adjacent to the image forming apparatus 100. Sheets having images formed thereon by the image forming apparatus 100 are conveyed to the sheet finishing apparatus 200.

The sheet finishing apparatus 200 applies finishing to the sheets fed from the image forming apparatus 100. For example, the sheet finishing apparatus 200 applies stapling to the sheets. The sheet finishing apparatus 200 is hereinafter referred to as finisher 200.

In FIG. 1, a document table is provided in an upper part of a main body 11 of the image forming apparatus 100. An auto document feeder (ADF) 12 is provided on the document table to be freely opened and closed. An operation panel 13 is provided in an upper part of the main body 11. The operation panel 13 includes an operation section 14 having various keys and a display section 15 of a touch panel type.

The main body 11 includes a scanner section 16 and a printer section 17. Plural cassettes 18 having stored therein sheets of various sizes are provided in a lower part of the main body 11. The scanner section 16 reads a document fed by the ADF 12 or a document placed on the document table.

The printer section 17 includes a photoconductive drum and a laser. The surface of the photoconductive drum is scanned and exposed by a laser beam from the laser to form an electrostatic latent image on the photoconductive drum. A charging device, a developing device, a transfer device, and the like are arranged around the photoconductive drum. The electrostatic latent image on the photoconductive drum is developed by the developing device and a toner image is formed on the photoconductive drum. The toner image is transferred onto a sheet by the transfer device. The configuration of the printer section 17 is not limited to the example explained above and can be various types.

A sheets having an image formed thereon by the main body 11 is conveyed to the finisher 200. In the example shown in FIG. 1, the finisher 200 includes a staple unit 20 configured to apply stapling to a sheet bundle. Sheets finished by the finisher 200 are discharged to a storage tray 26 or a fixed tray 27.

The staple unit 20 receives, with an inlet roller 21 of the staple unit 20, the sheet S fed via a conveying roller 19 of the image forming apparatus 100. A conveying roller 22 and an aligning roller 23 are provided on a downstream side of the inlet roller 21. The staple unit 20 conveys the sheet S in the direction of the storage tray 26.

A stapler 24 is arranged in a position slightly shifted from a conveying path for the sheet S. After the sheet S passes the conveying roller 22, the staple unit 20 presses the sheet S with the aligning roller 23, moves the sheet S in a lateral direction (the direction of the stapler 24) orthogonal to a conveying direction of the sheet S, and presses a side end of the sheet S against a positioning stopper to laterally align the sheet S. The staple unit 20 staples a corner portion of laterally-aligned sheets with the stapler 24. The staple unit 20 also serves as an aligning device configured to align conveyed sheets in the width direction.

After stapling the sheets, the staple unit 20 rotates the aligning roller 23 and discharges the sheets from a discharge port 25 to the storage tray 26. The storage tray 26 rises and falls to receive the sheets. In some case, the staple unit 20 aligns the sheets and discharges the sheets to the storage tray 26 without stapling the sheets. When the staple unit 20 does not finish the sheets, the staple unit 20 can also discharge the sheets to the fixed tray 27.

Figure 2:
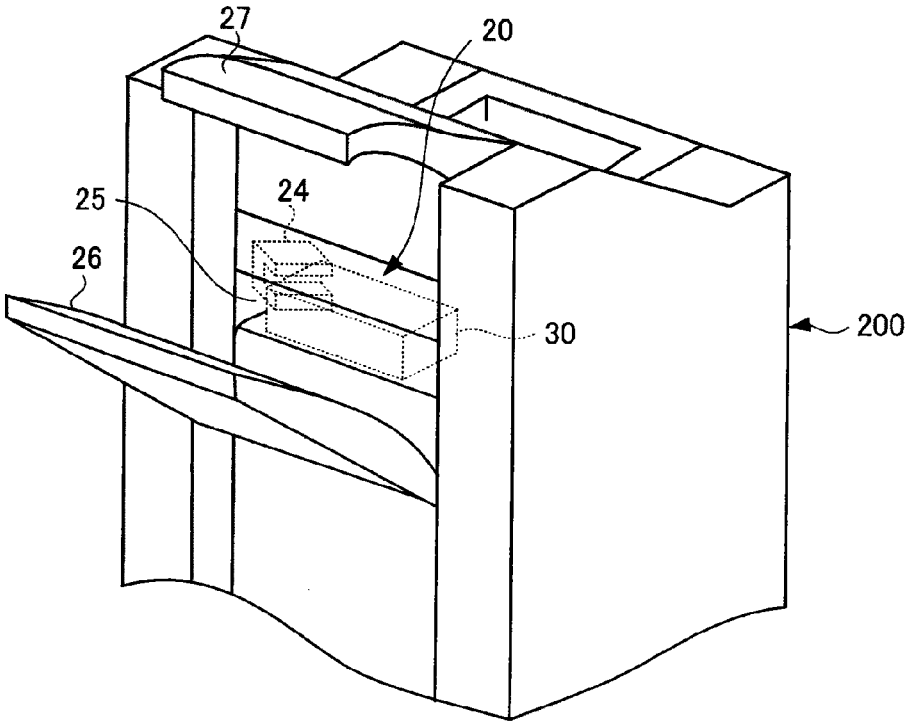
FIG. 2 is a schematic perspective view of a staple unit.

FIG. 2 is a perspective view of the finisher 200 viewed from the discharge port 25 side. The staple unit 20 is schematically shown in FIG. 2.

The staple unit 20 is provided near the discharge port 25 and includes the stapler 24 and a driving section 30 for the aligning roller 23. The driving section 30 controls the rotation and the movement of the aligning roller 23.

Figure 3:
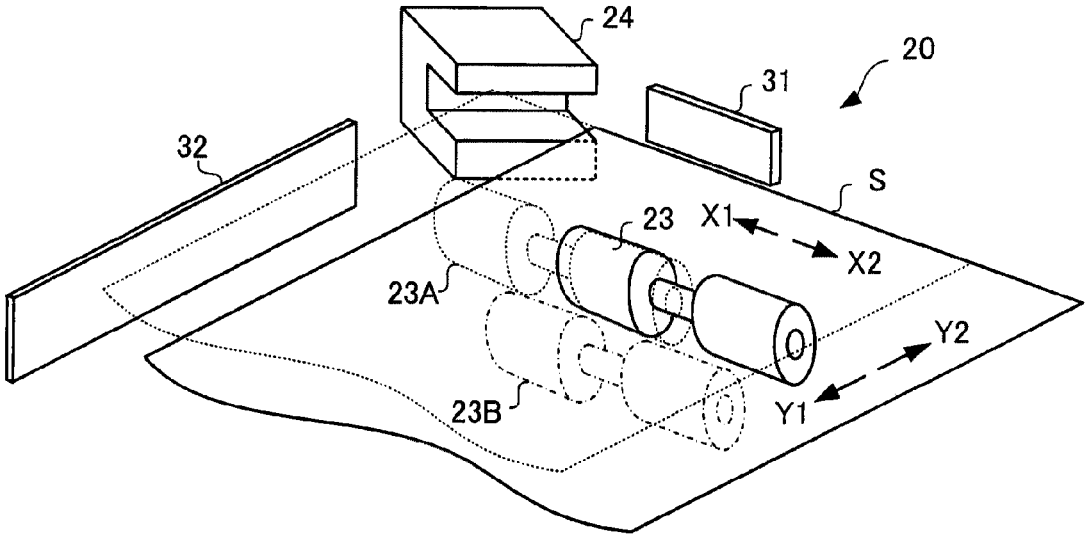
FIG. 3 is a schematic perspective view of the operation of a driving section of an aligning roller.

FIG. 3 is a schematic perspective view of the operation of the rotation and the movement of the aligning roller 23 by the driving section 30.

In FIG. 3, the sheet S is conveyed in a Y1 direction by the conveying roller 22 and the aligning roller 23. When the trailing end of the sheet S passes the conveying roller 22, the aligning roller 23 reversely rotates to convey the sheet S in the opposite direction (upstream in the conveying direction: a Y2 direction) a little and bumps the trailing end of the sheet S against a stopper 31 to longitudinally align the sheet S. The stopper 31 is provided in a direction orthogonal to the conveying direction of the sheet S.

After longitudinally aligning the sheet S, the aligning roller 23 stops the rotation and moves in the lateral direction orthogonal to the conveying direction. Therefore, as indicated by a dotted line 23A, the aligning roller 23 conveys the sheet S in an X1 direction orthogonal to the conveying direction while staying in contact with the sheet S. The surface of the aligning roller 23 is formed of an elastic member (e.g., rubber). The aligning roller 23 moves the sheet S in the X1 direction with friction and presses a side end of the sheet S against a positioning stopper 32 to laterally align the sheet S. The stopper 32 is provided in parallel to the conveying path for the sheet S.

When there are following sheets, the staple unit 20 sequentially laterally aligns uppermost one sheet and stacks the sheets on the storage tray 26 according to the same procedure. A corner of the laterally-aligned sheets enters the stapler 24 and can be stapled. After the sheets are stapled, the aligning roller 23 rotates and conveys the sheets in the Y1 direction.

The aligning roller 23 can also move in a conveying direction (Y1-Y2) of the sheet S. When a size of the sheet S is large, as indicated by an alternate long and short dash line 23B, the aligning roller 23 moves in the conveying direction (Y1) by a predetermined distance to come into contact with the sheet S and moves in the X1 direction to laterally align the sheet S. The aligning roller 23 may be moved in an X1-X2 direction and the Y1-Y2 direction according to a size of the sheet S.

A distal end of a sheet shifts more as the sheet is longer. Therefore, the sheet is more satisfactorily laterally aligned when the aligning roller 23 is moved as close as possible to the center of the sheet to press the sheet. Therefore, possible to reduce the likelihood that a lateral alignment failure occurs when a sheet size is changed.

Figure 4:
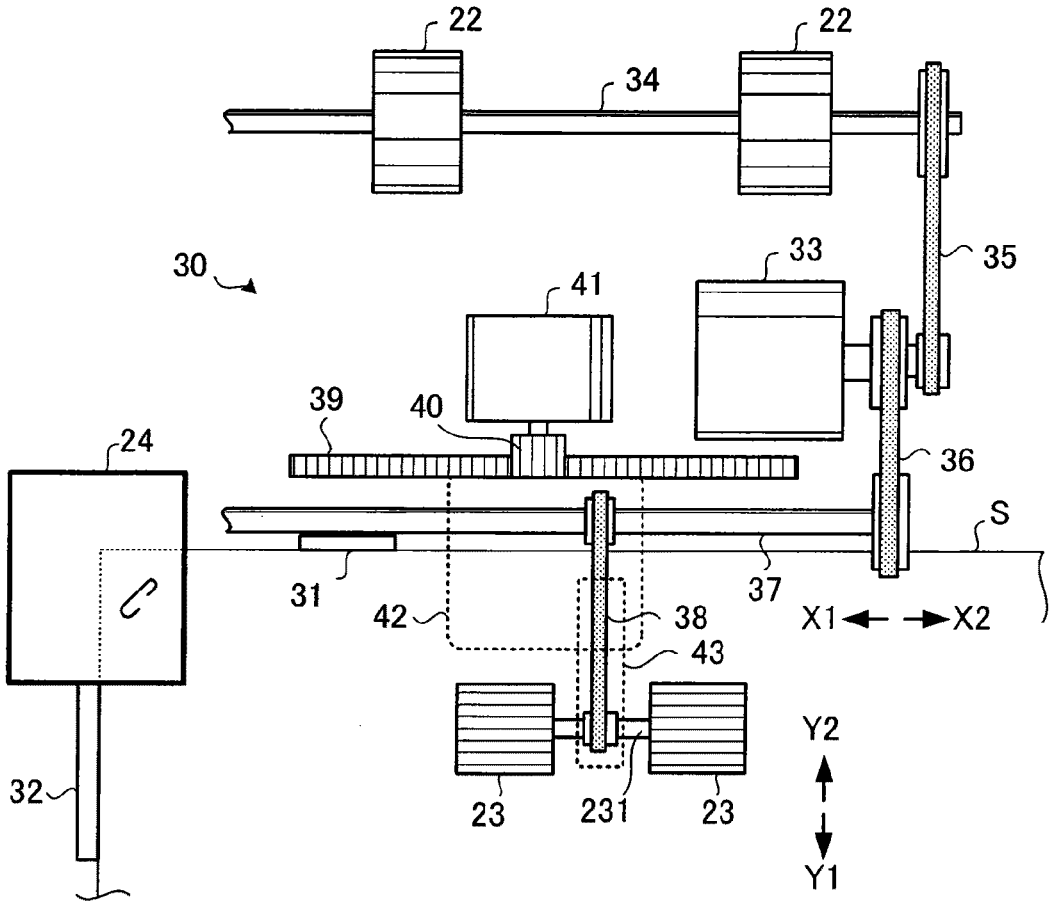
FIG. 4 is a plan view of a specific example of the driving section of the aligning roller.

FIG. 4 is a plan view of a specific example of the driving section 30. The rotation of the aligning roller 23 and a configuration for movement in the X1-X2 direction orthogonal to the conveying direction are mainly shown.

The driving section 30 includes a conveyance motor 33 as a driving source for the conveying roller 22 and the aligning roller 23. The conveying roller 22 is attached to the shaft 34. The rotation of the conveyance motor 33 is transmitted to the shaft 34 via a belt 35 to rotate the conveying roller 22. The rotation of the conveyance motor 33 is also transmitted to a shaft 37 via a belt 36.

The aligning roller 23 is attached to a shaft 231. A stretchable rubber belt 38 is suspended between the shaft 37 and the shaft 231. When the shaft 37 rotates, the shaft 231 rotates and the aligning roller 23 rotates.

A rack 39 is provided in parallel to the shaft 37. A pinion 40 configured to mesh with the rack 39 and rotate is provided. The pinion 40 is rotated by a motor 41. A supporting member 42 configured to support the aligning roller 23 is integrally attached to the rack 39. When the pinion 40 is rotated by the rotation of the motor 41, the rack 39 moves in the X1-X2 direction in parallel to the shaft 37. The supporting member 42 also moves in the X1-X2 direction.

When the supporting member 42 moves in the X1 direction, the aligning roller 23 presses the sheet S against the positioning stopper 32 and laterally aligns the sheet S. The aligning roller 23 can normally and reversely rotate. During the normal rotation, the aligning roller 23 conveys the sheet S in the Y1 direction, i.e., to the storage tray 26. During the reverse rotation, the aligning roller 23 conveys the sheet S in the Y2 direction and presses the sheet S against the stopper 31 to longitudinally align the sheet S.

The aligning roller 23 is supported by a moving member 43. The moving member 43 is movable in the conveying direction Y1 of the sheet S. When the moving member 43 moves in the Y1 direction, the rubber belt 38 slightly stretches and transmits the rotation of the shaft 37 to the shaft 231.

Figure 5:
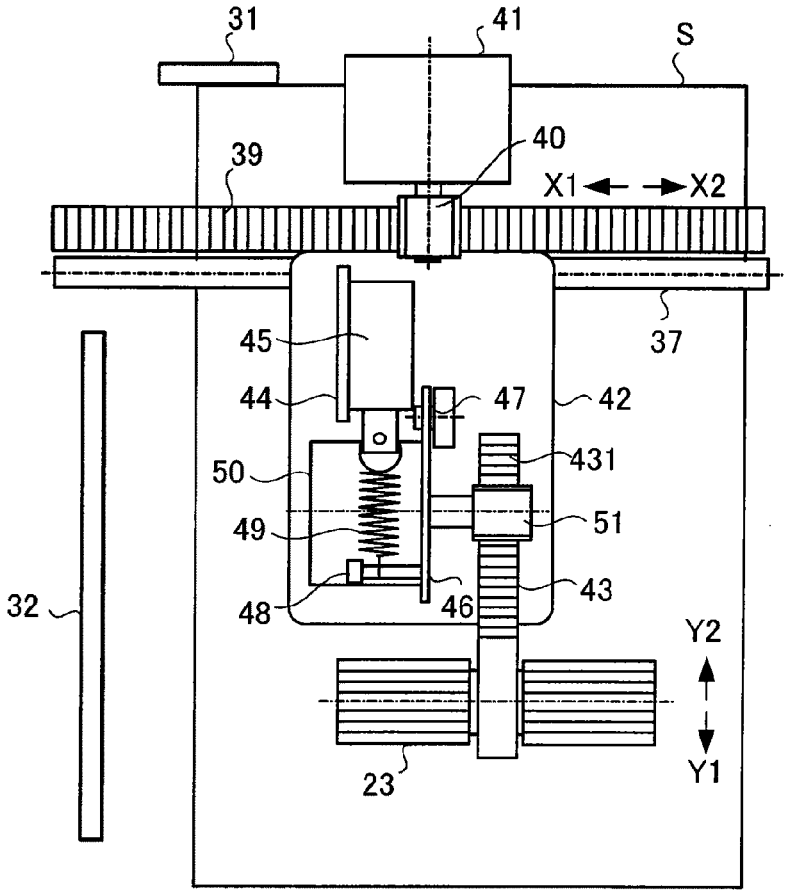
FIG. 5 is a plan view of a moving mechanism for the aligning roller.
Figure 6:
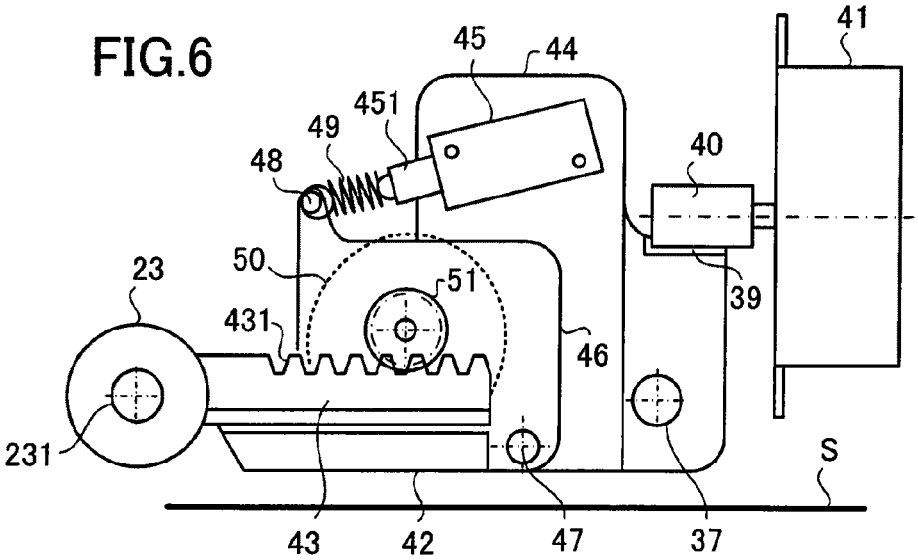
FIG. 6 is a side view of the moving mechanism for the aligning roller.

FIG. 5 is a plan view of a moving mechanism for moving the aligning roller 23 in the conveying direction (the Y1-Y2 direction) of the sheet S. FIG. 6 is a side view of the moving mechanism.

An erected attaching plate 44 is provided on the supporting member 42. A solenoid 45 is attached to the attaching plate 44. A bracket 46 is provided in parallel to the attaching plate 44 in a position slightly shifted from the attaching plate 44. The bracket 46 is pivotable with a shaft 47 as a fulcrum. A pin 48 is provided at an upper end on a diagonal of the bracket 46 with respect to the shaft 47. A driving element 451 of the solenoid 45 is coupled to the pin 48 via a spring 49.

A motor 50 is attached to the bracket 46. A pinion 51 is attached to a shaft of the motor 50. The pinion 51 meshes with a rack 431 formed in the moving member 43. The moving member 43 is attached to the bracket 46 to be movable in the conveying direction (the Y1-Y2 direction) of the sheet S.

Figure 7:
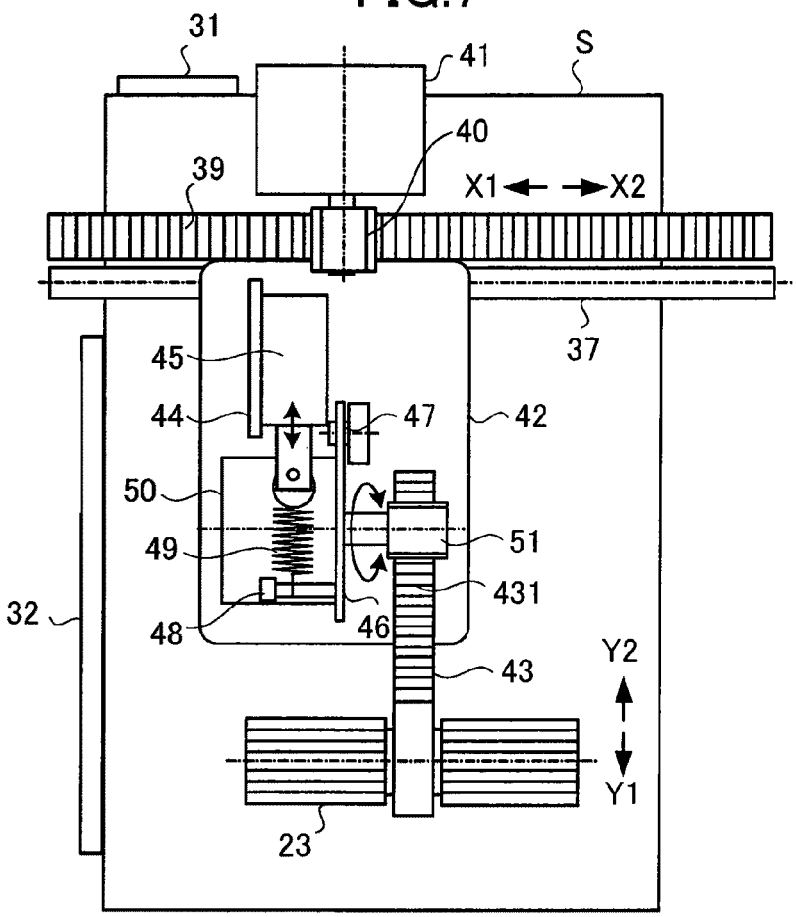
FIG. 7 is a plan view of the operation of the operation of the moving mechanism for the aligning roller.
Figure 8:
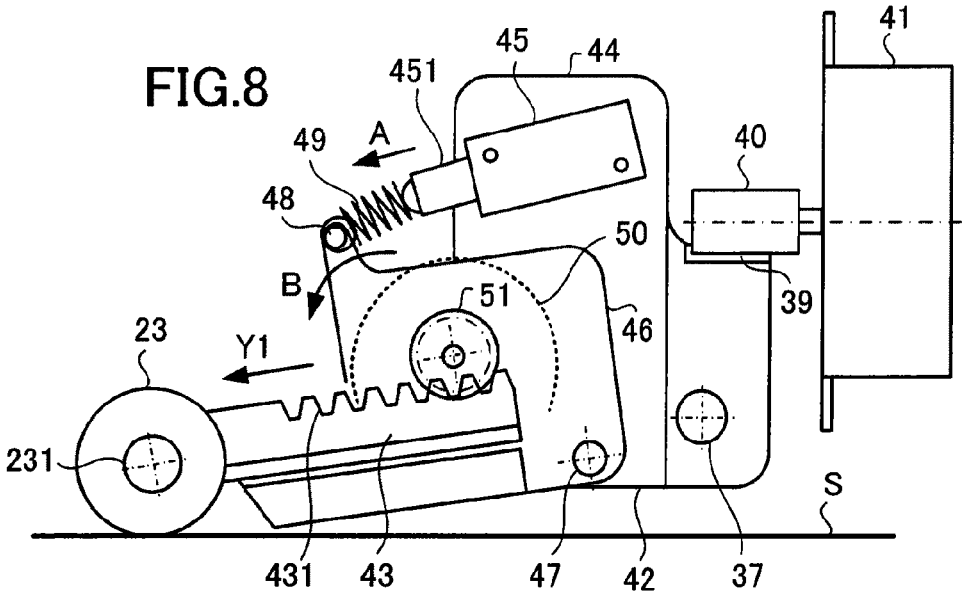
FIG. 8 is a side view of the operation of the moving mechanism for the aligning roller.

FIGS. 7 and 8 are diagrams of a state in which the solenoid 45 is driven to press the aligning roller 23 against the sheet S.

As shown in FIG. 8, when the solenoid 45 is driven, the driving element 451 projects, the pin 48 is pushed in an arrow A direction via the spring 49, and the bracket 46 pivots in an arrow B direction with the shaft 47 as a fulcrum. The moving member 48 also pivots according to the pivoting of the bracket 46. The aligning roller 23 comes into contact with the sheet S.

When the pinion 40 rotates according to the rotation of the motor 41, the rack 39 moves in the X1-X2 direction orthogonal to the conveying direction of the sheet S and the supporting member 42 also moves. Therefore, the aligning roller 43 moves in the X1-X2 direction. When the motor 50 rotates, the pinion 51 rotates and the moving member 43 moves in the Y1-Y2 direction.

For example, when long sheets (e.g., A3 sheets) are stapled, the moving member 43 supporting the aligning roller 23 is moved in the conveying direction (the Y1 direction) and brought into contact with the sheet S. The aligning roller 23 is moved in the X1 direction to press the sheet S against the positioning member 32 and laterally align the sheet S.

When short sheets (e.g., A4 sheets) are stapled, the moving member 43 is moved in a direction (the Y2 direction) opposite to the conveying direction and brought into contact with the sheet S. The aligning roller 23 is moved in the X1 direction to press the sheet S against the positioning member 32 and laterally align the sheet S.

A distal end of a sheet shifts more as the sheet is longer. Therefore, the sheet is more satisfactorily laterally aligned when the aligning roller 23 is moved as close as possible to the center of the sheet to press the sheet.

The aligning roller 23 may be moved in the X1-X2 direction and the Y1-Y2 direction according to a size of the sheet S to laterally align the sheet S.

Information concerning a sheet size can be acquired from the image forming apparatus 100. For example, a user may operate the operation panel 13 to instruct a sheet size or measure a sheet size with a sensor. Therefore, possible to control the rotation of the motor 41 and the motor 50 according to a size of a sheet and change the position of the aligning roller 23.

Figure 9:
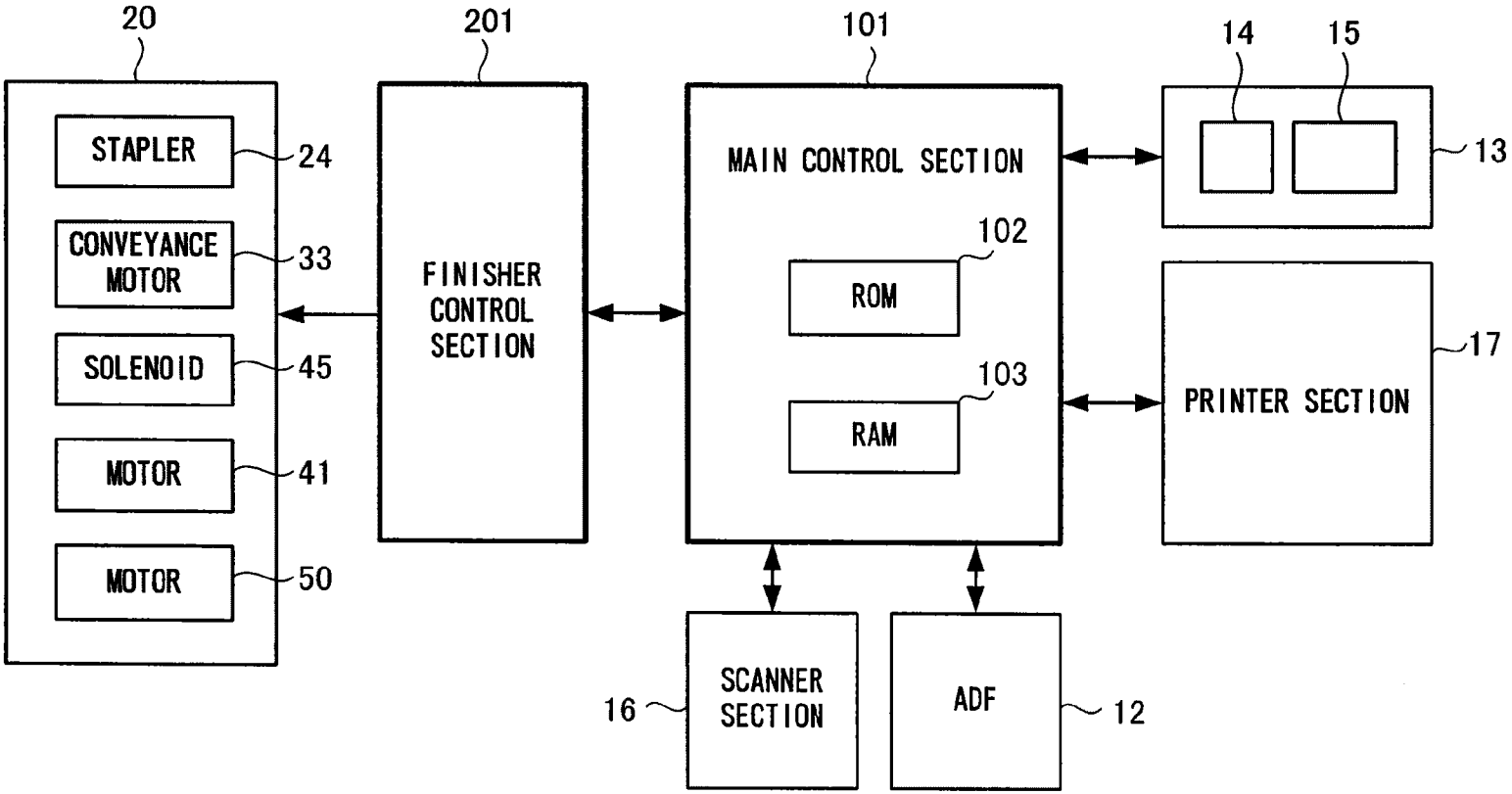
FIG. 9 is a block diagram of a control system for the image forming apparatus and the finisher.

FIG. 9 is a block diagram of a control system for the image forming apparatus 100 and the finisher 200. In FIG. 9, a main control section 101 includes a CPU, a ROM 102, and a RAM 103 and controls the image forming apparatus 100 according to a control program stored in the ROM 102. The main control section 101 controls the operation of the ADF 12, the scanner section 16, and the printer section 17 in response to the operation of the operation panel 13. The RAM 103 temporarily stores control data and is used for arithmetic operation work during the control.

The operation panel 13 includes plural keys 14 and a display section 15 also serving as a touch panel. The user can give various instructions for image formation to the image forming apparatus 100 through the operation panel 13. For example, the user gives instructions for the number of copies using the keys 14 and gives instructions for a sheet size, a sheet type, stapling, and the like by operating the touch panel of the display section 15.

A finisher control section 201 controls the operation of the finisher 200. The finisher control section 201 is connected to the main control section 101 and transmits information to and receives information from the main control section 101. The image forming apparatus 100 and the finisher 200 operate in association with each other. The finisher control section 201 controls the staple unit 20.

Examples of the control of the staple unit 20 include the control of the stapler 24, the control of the conveyance motor 33, and the control of the solenoid 45. The finisher control section 201 controls the motor 41 to change the position in the lateral direction of the aligning roller 23. The finisher control section 201 controls the motor 50 according to a sheet size to change the position in the longitudinal direction of the aligning roller 23. After the stapling, the finisher control section 201 controls the conveyance motor 33 to discharge sheets.

In this embodiment is possible to use the aligning roller 23 for both the conveyance and the lateral alignment of a sheet. And in this embodiment is possible to reduce mistakes of the lateral alignment and accurately perform stapling by changing the position in the longitudinal direction (or the position in the lateral direction) of the aligning roller 23 according to a sheet size.

The present invention is not limited to the embodiment. Various modifications are possible without departing from the scope of claims. For example, the staple unit 20 may be incorporated in the image forming apparatus 100.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. A sheet finishing apparatus comprising:

a storage tray on which a sheet is stacked;

a conveying roller configured to convey the sheet to the storage tray;

a positioning stopper provided in parallel to a conveying path for the sheet;

an aligning roller configured to convey the sheet, come into contact with the sheet, move the sheet in a lateral direction orthogonal to a direction of the conveyance, and press the sheet against the stopper to laterally align the sheet;

a moving mechanism configured to move a position of the aligning roller in the conveying direction; and a control section configured to control the position of the aligning roller according to a size of the sheet.

2. The apparatus of claim 1, wherein the control section controls the moving mechanism to increase an amount of movement in the conveying direction of the aligning roller as the size of the sheet is larger.

3. The apparatus of claim 1, wherein the control section controls, according to the size of the sheet, a position in the lateral direction of the aligning roller and an amount of movement in the conveying direction of the aligning roller.

4. The apparatus of claim 1, wherein the moving mechanism includes:

a moving member configured to support the aligning roller;

a first driving section configured to drive the aligning roller supported by the moving member in a direction in which the aligning roller comes into contact with the sheet; and a second driving section configured to move the moving member in the conveying direction.

5. The apparatus of claim 4, wherein the first driving section includes a solenoid configured to pivot a bracket to which the moving member is attached, and the second driving section includes a rack formed in the conveying direction of the moving member and a pinion that is driven by a motor attached to the bracket and rotates in mesh with the rack.

6. The apparatus of claim 1, further comprising a second stopper provided in a direction orthogonal to the conveying direction of the sheet between the conveying roller and the aligning roller, wherein the aligning roller can normally and reversely rotate and conveys, during the normal rotation, the sheet to a downstream side in the conveying direction and conveys, during the reverse rotation, the sheet to an upstream side in the conveying direction and presses a trailing end of the sheet against the second stopper to align the sheet in a longitudinal direction.

7. The apparatus of claim 6, further comprising a stapler configured to staple the sheet laterally aligned by the positioning stopper and longitudinally aligned by the second stopper.

8. A sheet finishing method comprising:

conveying a sheet to a storage tray, with a conveying roller;

providing a positioning stopper in parallel to a conveying path for the sheet;

bringing an aligning roller, which can convey the sheet, into contact with the sheet, moving the sheet in a lateral direction orthogonal to a direction of the conveyance, and pressing the sheet against the stopper to laterally align the sheet;

moving a position of the aligning roller in the conveying direction, with a moving mechanism; and controlling the position of the aligning roller according to a size of the sheet.

9. The method of claim 8, further comprising controlling the moving mechanism to increase an amount of movement in the conveying direction of the aligning roller as the size of the sheet is larger.

10. The method of claim 8, further comprising controlling, according to the size of the sheet, a position in the lateral direction of the aligning roller and an amount of movement in the conveying direction of the aligning roller.

11. The method of claim 8, wherein the moving mechanism includes a moving member configured to support the aligning roller, and the method further comprises:

driving the aligning roller supported by the moving member in a direction in which the aligning roller comes into contact with the sheet, with a first driving section; and moving the moving member in the conveying direction, with a second driving section.

12. The method of claim 11, wherein the first driving section includes a solenoid configured to pivot a bracket to which the moving member is attached, and the second driving section includes a rack formed in the conveying direction of the moving member and a pinion that is driven by a motor attached to the bracket and rotates in mesh with the rack.

13. The method of claim 8, further comprising providing a second stopper in a direction orthogonal to the conveying direction of the sheet between the conveying roller and the aligning roller, wherein the aligning roller conveys, during normal rotation, the sheet to a downstream side in the conveying direction and conveys, during reverse rotation, the sheet to an upstream side in the conveying direction and presses a trailing end of the sheet against the second stopper to align the sheet in a longitudinal direction.

14. The method of claim 13, further comprising stapling the sheet laterally aligned by the positioning stopper and longitudinally aligned by the second stopper.

15. An image forming apparatus comprising:

an image forming section configured to form an image on a sheet;

a storage tray on which the sheet is stacked;

a conveying roller configured to convey the sheet, which is supplied from the image forming section, to the storage tray;

a positioning stopper provided in parallel to a conveying path for the sheet;

an aligning roller configured to convey the sheet, come into contact with the sheet, move the sheet in a lateral direction orthogonal to a direction of the conveyance, and press the sheet against the stopper to laterally align the sheet;

a moving mechanism configured to move a position of the aligning roller in the conveying direction; and a control section configured to control the position of the aligning roller according to a size of the sheet.

16. The apparatus of claim 15, wherein the control section controls the moving mechanism to increase an amount of movement in the conveying direction of the aligning roller as the size of the sheet is larger.

17. The apparatus of claim 15, wherein the moving mechanism includes:

a moving member configured to support the aligning roller;

a first driving section configured to drive the aligning roller supported by the moving member in a direction in which the aligning roller comes into contact with the sheet; and a second driving section configured to move the moving member in the conveying direction.

18. The apparatus of claim 17, wherein the first driving section includes a solenoid configured to pivot a bracket to which the moving member is attached, and the second driving section includes a rack formed in the conveying direction of the moving member and a pinion that is driven by a motor attached to the bracket and rotates in mesh with the rack.

19. The apparatus of claim 15, further comprising a second stopper provided in a direction orthogonal to the conveying direction of the sheet between the conveying roller and the aligning roller, wherein the aligning roller can normally and reversely rotate and conveys, during the normal rotation, the sheet to a downstream side in the conveying direction and conveys, during the reverse rotation, the sheet to an upstream side in the conveying direction and presses a trailing end of the sheet against the second stopper to align the sheet in a longitudinal direction.

20. The apparatus of claim 19, further comprising a stapler configured to staple the sheet laterally aligned by the positioning stopper and longitudinally aligned by the second stopper.

* * * * *